US011284482B2

(12) United States Patent
Voss et al.

(10) Patent No.: US 11,284,482 B2
(45) Date of Patent: Mar. 22, 2022

(54) HIGH TEMPERATURE SMART SUSCEPTOR HEATING BLANKET AND METHOD

(71) Applicant: The Boeing Company, Chicago, IL (US)

(72) Inventors: Bret A. Voss, Seattle, WA (US); Marc R. Matsen, Seattle, WA (US)

(73) Assignee: The Boeing Company, Chicago, IL (US)

( * ) Notice: Subject to any disclaimer, the term of this patent is extended or adjusted under 35 U.S.C. 154(b) by 497 days.

(21) Appl. No.: 16/123,944

(22) Filed: Sep. 6, 2018

(65) Prior Publication Data

US 2020/0084841 A1 Mar. 12, 2020

(51) Int. Cl.

| | |
|---|---|
| ***H05B 6/10*** | (2006.01) |
| *B05D 3/00* | (2006.01) |
| *B28B 11/24* | (2006.01) |

(52) U.S. Cl.

CPC ..... *H05B 6/105* (2013.01); *B05D 3/007* (2013.01); *B28B 11/24* (2013.01); *H05B 2206/023* (2013.01); *H05B 2206/024* (2013.01); *H05B 2213/00* (2013.01); *H05B 2214/00* (2013.01)

(58) Field of Classification Search

CPC ..... B05D 3/007; H05B 2206/023; H05B 2206/024; H05B 2213/00; H05B 6/105

USPC ..... 219/618, 634, 635

See application file for complete search history.

(56) References Cited

U.S. PATENT DOCUMENTS 4,463,547 A 8/1984 Young
4,470,248 A 9/1984 Nortenius
5,330,608 A 7/1994 Kemmler et al.
5,517,812 A 5/1996 Simmons
5,705,795 A * 1/1998 Anderson ..... B29C 66/73921 219/633
5,717,191 A * 2/1998 Christensen ..... B29C 66/524 219/634
5,723,849 A * 3/1998 Matsen ..... B29C 70/44 219/634
5,728,309 A * 3/1998 Matsen ..... B22F 3/105 219/633

(Continued)

FOREIGN PATENT DOCUMENTS

EP 3169139 A1 5/2017
EP 3169140 A1 5/2017

OTHER PUBLICATIONS

Office Action for related European Application No. EP19181508.3; report dated Dec. 12, 2019.

(Continued)

*Primary Examiner* — Jimmy Chou
(74) *Attorney, Agent, or Firm* — Quinn IP Law

(57) ABSTRACT

A heating blanket includes an interlaced heating layer having a fabric thread and a heat-generating thread interlaced with the fabric thread to form the interlaced heating layer. The heat-generating thread includes a conductor wire configured to generate a magnetic field in response to an electrical current applied to the conductor wire, and a susceptor wire formed of a susceptor material configured to inductively generate heat in response to the magnetic field of the conductor wire when a temperature of the susceptor wire is below a Curie point of the susceptor wire. Methods of forming the heating blanket and methods of heating a contoured surface using the heating blanket are also disclosed.

20 Claims, 6 Drawing Sheets

(56) References Cited

U.S. PATENT DOCUMENTS 6,080,690 A * 6/2000 Lebby ..... A41D 31/00 139/420 R
6,602,810 B1 * 8/2003 Christensen ..... B29C 66/7212 442/232
7,034,251 B1 4/2006 Child et al.
7,520,120 B2 4/2009 Saito et al.
7,698,883 B2 4/2010 Dye
8,236,223 B2 8/2012 Graves et al.
8,330,086 B2 12/2012 Miller et al.
9,259,886 B2 2/2016 Matsen et al.
9,719,194 B2 8/2017 Chi-Hsueh
9,986,602 B2 5/2018 Chen et al.
10,129,934 B2 * 11/2018 Kestner ..... H05B 6/105
10,470,253 B2 * 11/2019 Miller ..... H05B 6/105
2004/0129924 A1 * 7/2004 Stark ..... B29C 66/91651 252/500
2005/0028512 A1 2/2005 Boni
2008/0083209 A1 4/2008 Saito et al.
2008/0128078 A1 * 6/2008 May ..... B29C 73/10 156/272.4
2008/0191391 A1 * 8/2008 Lasko ..... H05B 6/105 264/431
2009/0101632 A1 * 4/2009 Naylor ..... H05B 1/0275 219/202
2009/0242548 A1 * 10/2009 Iida ..... H05B 3/58 219/529
2011/0139769 A1 * 6/2011 Miller ..... H05B 6/106 219/634
2012/0145702 A1 * 6/2012 Miller ..... H05B 6/106 219/618
2012/0145703 A1 * 6/2012 Matsen ..... H05B 6/105 219/618
2013/0082047 A1 * 4/2013 Matsen ..... H05B 6/06 219/634
2015/0156826 A1 * 6/2015 Erle ..... H05B 6/6408 426/107
2015/0218734 A1 * 8/2015 Chi-Hsueh ..... D02G 3/12 57/222
2015/0320116 A1 * 11/2015 Bleloch ..... H05B 6/108 219/628
2015/0321919 A1 * 11/2015 Magel ..... D01F 9/21 423/447.7
2016/0143092 A1 * 5/2016 Miller ..... H05B 6/06 219/634
2016/0262216 A1 * 9/2016 Kestner ..... H05B 6/105
2017/0092421 A1 3/2017 Hottes et al.
2017/0094729 A1 3/2017 Hottes et al.
2017/0135156 A1 * 5/2017 Miller ..... H05B 3/36
2017/0135157 A1 * 5/2017 Miller ..... H05B 3/36
2019/0380174 A1 * 12/2019 Hull ..... H05B 6/04

OTHER PUBLICATIONS

Kimmo Ainassaari, "Heat Treatment Equipment & Accessories", ElectroHeat Industrial Ovens, ElectroHeat AB, Goteborg, Sweden.
"FCP—Flexible Ceramic Pad Heaters", FCP—Flexible Ceramic Pad Heaters—Electroheat, https://www.electroheat.com/product/fce-flexible-ceramic-pad-heaters/, Jun. 7, 2018, p. 1.

* cited by examiner

HIGH TEMPERATURE SMART SUSCEPTOR HEATING BLANKET AND METHOD

FIELD

The present disclosure generally relates to heating blankets and, more particularly, to heating blankets and methods for heating a structure to a substantially uniform temperature across the structure.

BACKGROUND

Heating blankets are used in industrial applications to manufacture and repair structures. In some applications, the structure has a complex, contoured surface, in which case it is advantageous for the heating blanket to be highly formable to conform to the structure surface. Additionally, some structures may be formed of materials that require a high temperature, such as in excess of 500° F., to manufacture or repair. Accordingly, it is highly desirable to provide a heating blanket and method that can conform to complex contours and heat to higher temperatures.

SUMMARY

In accordance with one aspect of the present disclosure, a heating blanket includes an interlaced heating layer having a fabric thread and a heat-generating thread interlaced with the fabric thread to form the interlaced heating layer. The heat-generating thread includes a conductor wire configured to generate a magnetic field in response to an electrical current applied to the conductor wire, and a susceptor wire formed of a susceptor material configured to inductively generate heat in response to the magnetic field of the conductor wire when a temperature of the susceptor wire is below a Curie point of the susceptor wire.

In accordance with another aspect of the present disclosure, a method is provided of forming an interlaced heating layer of a heating blanket. The method includes providing a heat-generating thread having a conductor wire formed of a plurality of conductor wire strands in a Litz wire configuration, the conductor wire configured to generate a magnetic field in response to an electrical current applied to the conductor wire, and a susceptor wire formed of a susceptor material configured to inductively generate heat in response to the magnetic field of the conductor wire when a temperature of the susceptor wire is below a Curie point of the susceptor wire. The heat-generating thread is interlaced with a fabric thread to form the interlaced heating layer.

In accordance with a further aspect of the present disclosure, a method of heating a contoured surface is provided. The method includes placing on the contoured surface a heating blanket, the heating blanket having an interlaced heating layer. The interlaced heating layer includes a fabric thread formed of a high temperature fabric material, and a heat-generating thread interlaced with the fabric thread to form the interlaced heating layer. The heat-generating thread includes a conductor wire configured to generate a magnetic field in response to an electrical current applied to the conductor wire, and a susceptor wire formed of a susceptor material configured to inductively generate heat in response to the magnetic field of the conductor wire when a temperature of the susceptor wire is below a Curie point of the susceptor wire, the Curie point being at least 500° F. The method further includes providing electrical current to the conductor wire to inductively heat the susceptor wire to the Curie point of the susceptor wire.

In another aspect of the disclosure that may be combined with any of these aspects, the conductor wire comprises a plurality of conductor wire strands bundled in a Litz wire configuration, and the susceptor wire is wrapped, around the conductor wire in a spiral configuration.

In another aspect of the disclosure that may be combined with any of these aspects, each conductor wire strand comprises a conductor wire metal core and a ceramic coating surrounding the conductor wire metal core.

In another aspect of the disclosure that may be combined with any of these aspects, the conductor wire metal core comprises pure nickel.

In another aspect of the disclosure that may be combined with any of these aspects, the conductor wire metal core comprises nickel clad copper.

In another aspect of the disclosure that may be combined with any of these aspects, the heating blanket further includes a sheath surrounding the plurality of conductor wire strands.

In another aspect of the disclosure that may be combined with any of these aspects, the sheath comprises a ceramic filament.

In another aspect of the disclosure that may be combined with any of these aspects, the sheath comprises a thermoplastic film.

In another aspect of the disclosure that may be combined with any of these aspects, the susceptor material comprises a high temperature susceptor material selected from the group consisting of an iron alloy, a cobalt alloy, and a nickel alloy.

In another aspect of the disclosure that may be combined with any of these aspects, the fabric thread is formed of a high temperature fabric material selected from the group consisting of fiberglass, vermiculite fiberglass, and ceramic fiber.

In another aspect of the disclosure that may be combined with any of these aspects, the heating blanket further includes a pair of outer layers sandwiching opposite sides of the interlaced heating layer, each outer layer being formed of an outer layer fabric material.

In another aspect of the disclosure that may be combined with any of these aspects, the Curie point of the susceptor material is at least 500° F.

In another aspect of the disclosure that may be combined with any of these aspects, the Curie point of the susceptor material is approximately 2000° F.

In another aspect of the disclosure that may be combined with any of these aspects, the conductor wire comprises a plurality of conductor wire circuits connected in parallel.

In another aspect of the disclosure that may be combined with any of these aspects, the conductor wire is arranged in a double-back configuration, so that the conductor wire includes a first segment, configured to carry current in a first direction, and a second segment positioned adjacent the first segment and configured to carry current in a second direction opposite the first direction.

In another aspect of the disclosure that may be combined with any of these aspects, the plurality of conductor wire strands is coated with a low temperature binder, the method further comprising melting off the low temperature binder.

The features, functions, and advantages that have been discussed can be achieved independently in various embodiments or may be combined in yet other embodiments further details of which can be seen with reference to the following description and drawings.

It should be understood that the drawings are not necessarily drawn to scale and that the disclosed embodiments are sometimes illustrated schematically. It is to be further appreciated that the following detailed description is merely exemplary in nature and is not intended to limit the invention or the application and uses thereof. Hence, although the present disclosure is, for convenience of explanation, depicted and described as certain illustrative embodiments, it will be appreciated that it can be implemented in various other types of embodiments and in various other systems and environments.

DETAILED DESCRIPTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
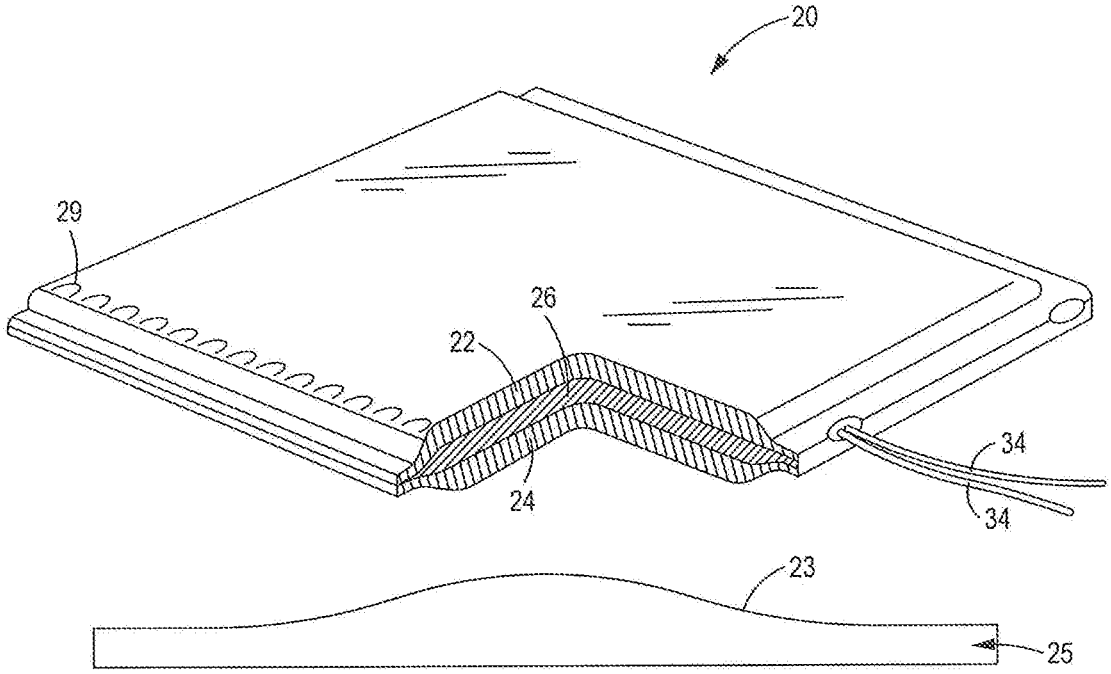
FIG. 1 is a perspective, partial cutaway view of a heating blanket, in accordance with one embodiment of the present disclosure.

FIG. 1 illustrates a cross-sectional view of a heating blanket 20, in accordance with an embodiment of the present disclosure. The heating blanket 20 may comprise a first outer layer 22, a second outer layer 24, and an interlaced heating layer 26 sandwiched therebetween. The first and second outer layers 22, 24 are optionally provided to protect the interlaced heating layer 26 and to prevent users from direct contact with the interlaced heating layer 26. As will be understood more fully below, the heating blanket 20 is capable of generating high temperatures of at least 500° F. and, in some embodiments at least 2000° F., and therefore each of the first outer layer 22 and the second outer layer 24 is composed of a high temperature fabric material, such as fiberglass, vermiculite fiberglass, or continuous ceramic oxide wire such as that sold by 3M® under the trademark Nextel™. The high-temperature fabric material may be formed as a thread that is woven, so that the first outer layer 22 and second outer layer 24 easily conform to a contoured surface 23 of a structure 25 on which the heating blanket 20 is placed. Furthermore, the first outer layer 22 may be joined directly to the second outer layer 24 after the interlaced heating layer 26 is positioned therebetween. For example, a drop stitch 29 may be used to connect the first outer layer 22 to the second outer layer 24. The drop stitch 29 may also be formed of a high-temperature fabric material, such as fiberglass, vermiculite fiberglass, or continuous ceramic oxide wire such as that sold by 3M® under the trademark Nextel™. Depending on the type of high-temperature fabric material that is used, the heating blanket 20 may have more layers than the first outer layer 22 and the second outer layer 24 surrounding the interlaced heating layer 26. Furthermore, certain heating applications may have specific heating requirements and/or complex geometries, in which case the heating blanket 20 may have more than one interlaced heating layer 26, such as multiple interlaced heating layers stacked together. In another embodiment, the heating blanket 20 may comprise the interlaced heating layer(s) 26 without any surrounding layers, such as the first outer layer 22 or the second outer layer 24.

Figure 2:
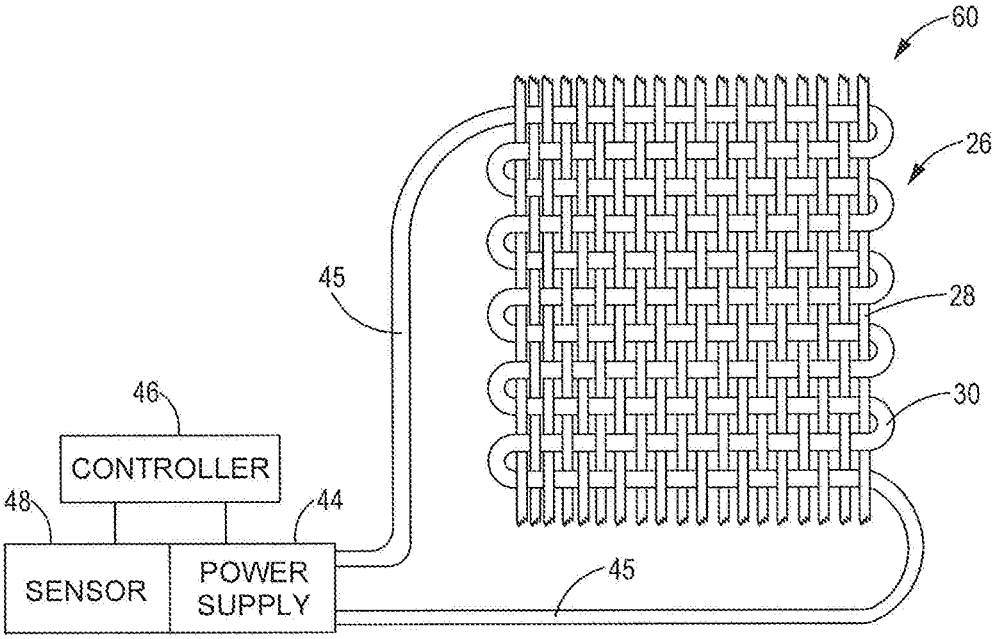
FIG. 2 is a schematic view of an embodiment of an interlaced heating layer used in the heating blanket of FIG. 1.

Referring now to FIG. 2, with continued reference to FIG. 1, the interlaced heating layer 26 is shown in accordance with an embodiment of the present disclosure. The interlaced heating layer 26 may comprise one or more fabric threads 28 interlaced with a heat-generating thread 30. As used herein, the term "thread" may refer to a single strand of material or multiple strands of material that are bundled together into a single cord. As will be understood more fully below, the materials used to form the fabric thread 28 and heat-generating thread 30 are highly formable so that the resulting interlaced heating layer 26 easily conforms to a contoured surface.

The fabric thread 28 is formed of a high-temperature fabric material capable of withstanding elevated temperatures. As used herein, the term "elevated temperatures" includes temperatures of at least 500° F. In some embodiments, the elevated temperature may be at least 1000° F. In other embodiments, the elevated temperature may be at least 2000° F. Suitable high temperature fabric materials include fiberglass, vermiculite fiberglass, or continuous ceramic oxide wire such as that sold by 3M® under the trademark Nextel™.

Figure 3:
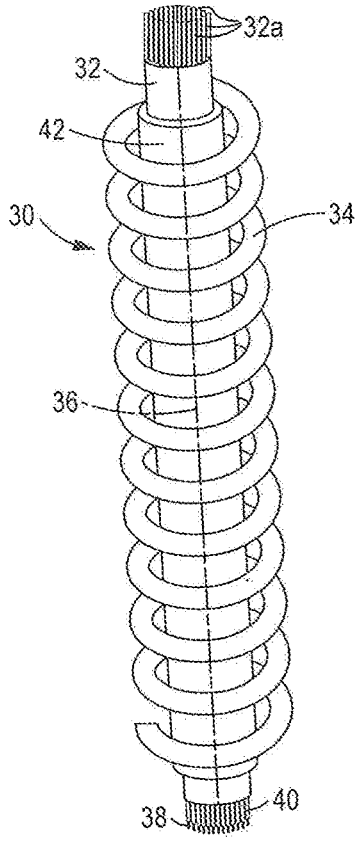
FIG. 3 is a perspective view of an embodiment of a heat-generating thread used in the interlaced heating layer of FIG. 2.

The heat-generating thread 30 includes multiple components that interact to inductively generate heat in response to an applied electrical current. As best shown in FIG. 3, the heat-generating thread 30 includes a conductor wire 32 and a susceptor wire 34. The conductor wire 32 is configured to receive an electrical current and generate a magnetic field in response to the electrical current. More specifically, electric current flowing through the conductor wire 32 generates a circular magnetic field around the conductor wire 32, with a central axis of the magnetic field coincident with an axis 36 of the conductor wire 32. If the conductor wire 32 is shaped into a cylindrical coil, the resulting magnetic field is co-axial with an axis of the coiled conductor wire 32.

In the illustrated embodiment, the conductor wire 32 is formed of a plurality of conductor wire strands **32*a* that are bundled together to form a Litz wire, as best shown in FIG. 3. More specifically, each conductor wire strand 32*a* may include a metal core 38 and a coating 40. The metal core 38** may be formed of an electrically conductive material suitable for high temperature applications. Exemplary metal core materials include nickel clad copper (suitable for temperatures up to approximately 1000° F.) and pure nickel (suitable for temperatures up to approximately 1500° F.).

The coating 40 surrounding the metal core 38 is formed of an electrical insulator material that is rated for high-temperature applications, such as ceramic.

A sheath 42 may be provided that surrounds and holds the plurality of conductor wire strands 32*a* in the bundled, Litz wire configuration. The sheath 42 may be a permanent component, in which case it is formed of a high-temperature material such as ceramic filament. Alternatively, the sheath 42 may be a sacrificial component that is subsequently removed. Exemplary sacrificial sheath materials include a low-melting point wax or thermoplastic film, which may be subsequently melted or burned off during fabrication of the interlaced heating layer 26.

The conductor wire 32 is operatively connected to a portable or fixed power supply 44, either directly or via wiring 45. The power supply 44 may provide alternating current electrical power to the conductor wire 32 and may be connected to a conventional electrical outlet. In addition, the power supply 44 may operate at higher frequencies. For example, the minimum practical frequency may be approximately 50 kilohertz, and the maximum practical frequency may be approximately 500 hundred kilohertz. Other frequencies, however, may be used. Furthermore, the power supply 44 may be connected to a controller 46 and a voltage sensor 48 or other sensing device configured to indicate a voltage level provided by the power supply 44. Based on the indicated voltage level from the voltage sensor 48, the controller 46 may adjust the alternating current of the power supply 44 over a predetermined range in order to facilitate application of the heating blanket 20 to various heating requirements. Furthermore, each conductor wire strand 32*a* may have a diameter sized for the electrical frequency to be carried. For example, the diameter of each conductor wire strand 32*a* may be 18-38 American Wire Gauge (AWG).

The susceptor wire 34 is configured to inductively generate heat in response to the magnetic field generated by the conductor wire 32. Accordingly, the susceptor wire 34 is formed of a metallic material that absorbs electromagnetic energy from the conductor wire 32 and converts that energy into heat. Thus, the susceptor wire 34 acts as a heat source to deliver heat via a combination of conductive and radiant heat transfer, depending on the distance between the susceptor wire 34 and a workpiece to be heated.

The susceptor wire 34 is formed of a material selected to have a Curie point that approximates a desired maximum heating temperature of the heating blanket 20. The Curie point is the temperature at which a material loses its permanent magnetic properties. When used in an inductive heating arrangement as described herein, where the susceptor wire 34 generates heat only as long as it is responsive to the magnetic field generated by the conductor wire 32, the amount of heat generated by the susceptor wire 34 will decrease as the Curie point is approached. For example, if the Curie point of the magnetic material for the susceptor wire 34 is 500° F., the susceptor wire 34 may generate two Watts per square inch at 450° F., may decrease heat generation to one Watt per square inch at 475° F., and may further decrease heat generation to 0.5 Watts per square inch at 490° F. As such, portions of the heating blanket 20 that are cooler due to larger heat sinks generate more heat and portions of the heating blanket 20 that are warmer due to smaller heat sinks generate less heat, thereby resulting in all portions of the heating blanket 20 arriving at approximately a same equilibrium temperature and reliably providing uniform temperature over the entire heating blanket 20. Thus, the interlaced heating layer 26 may provide uniform application of heat to an area to which the heating blanket 20 is applied, compensating for heat sinks that draw heat away from portions of the area that is being heated by the blanket 20. For example, the interlaced heating layer 26 will continue to heat portions of the area that have not reached the Curie point, while at the same time, ceasing to provide heat to portions of the area that have reached the Curie point. In so doing, the temperature-dependent magnetic properties, such as the Curie point of the magnetic material used in the susceptor wire 34, may prevent over-heating or under-heating of areas to which the heating blanket 20 is applied.

The susceptor wire 34 may be formed of a susceptor material suitable for high temperature applications. Exemplary high temperature susceptor materials include iron alloys, cobalt alloys, nickel alloys, or combinations thereof. The exact composition of the susceptor material may be selected based on a desired Curie point. For example, pure nickel has a Curie point of 669° F., pure iron has a Curie point of 1418° F., and pure cobalt has a Curie point of 2060° F. Accordingly, the amount of nickel, iron, and cobalt (as well as other trace elements, such as molybdenum) used in an alloy may be adjusted to achieve a desired Curie point. An alloy having a higher concentration of cobalt, for example, may be selected to provide a susceptor material having a Curie point of approximately 2000° F. Alternatively, an alloy having a higher concentration of iron and other materials having a lower Curie point may be selected to provide a susceptor material having a Curie point of approximately 500° F. Regardless of the exact composition of the susceptor material, the resulting Curie point of that susceptor material will approximate a maximum heating temperature of the heating blanket 20, as noted above.

The susceptor wire 34 may be sized to balance heating capacity with the smart response of the wire as it reaches the Curie point of the susceptor wire material. On the one hand, a larger diameter susceptor wire 34 provides more mass available to provide heat at temperatures below the Curie point. On the other hand, an increased diameter for the susceptor wire 34 will delay the smart effect achieved when the susceptor wire reaches the Curie point. Although susceptor wire diameter may impact the watts per square inch generated by the heating blanket 20, the Curie point of the susceptor wire 32 will still approximate the maximum temperature of the heating blanket 20.

The conductor wire 32 and susceptor wire 34 may be assembled together to form the heat-generating thread 30 suitable for interlacing with the fabric thread 28. For example, in the embodiment illustrated in FIG. 3, the susceptor wire 34 may be wrapped around the conductor wire 32 in a spiral configuration. Winding the susceptor wire 34 around the conductor wire 32 not only positions the susceptor wire 34 sufficiently proximate the conductor wire 32 to magnetically couple the wires, but also mechanically secures the conductor wire 32 in place, which is particularly advantageous when the conductor wire 32 is formed of a plurality of conductor wire strands 32*a*. Furthermore, arranging the susceptor wire 34 around the conductor wire 32 permits the use of a sacrificial sheath 42, as the susceptor wire 34 will secure the conductor wire strands 32*a* after the sheath 42 is burned off. Alternatively, however, an opposite configuration may be used, in which the conductor wire 32 is wrapped around the susceptor wire 34. Still further, other assembly configurations of the conductor wire 32 and the susceptor wire 34 may be used that achieve the necessary electro-magnetic coupling of the wires while also giving the heat-generating thread 30 an assembled shape that facilitates interlacing with the fabric thread 28.

Figure 4:
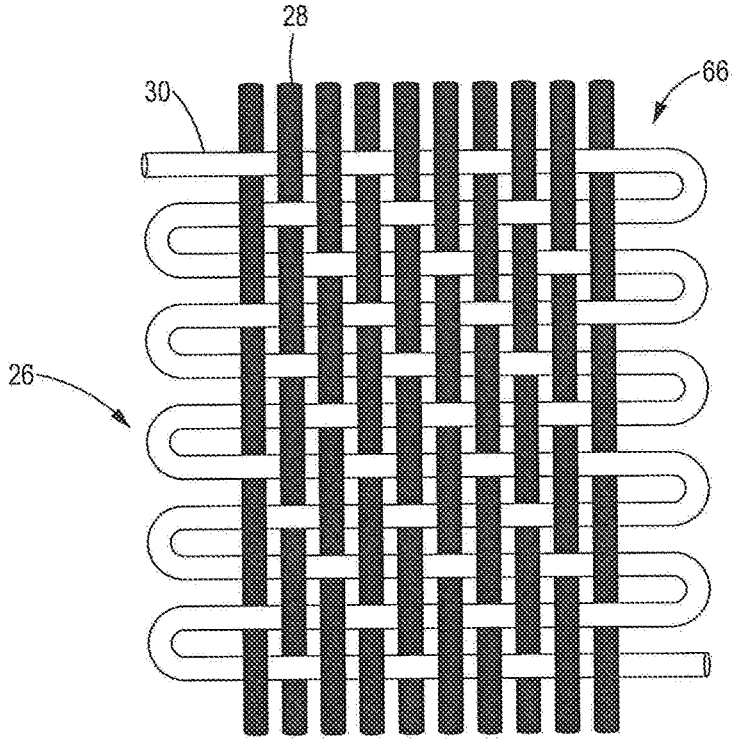
FIG. 4 is a side view of an embodiment of an interlaced heating layer having a twill weave pattern.
Figure 5:
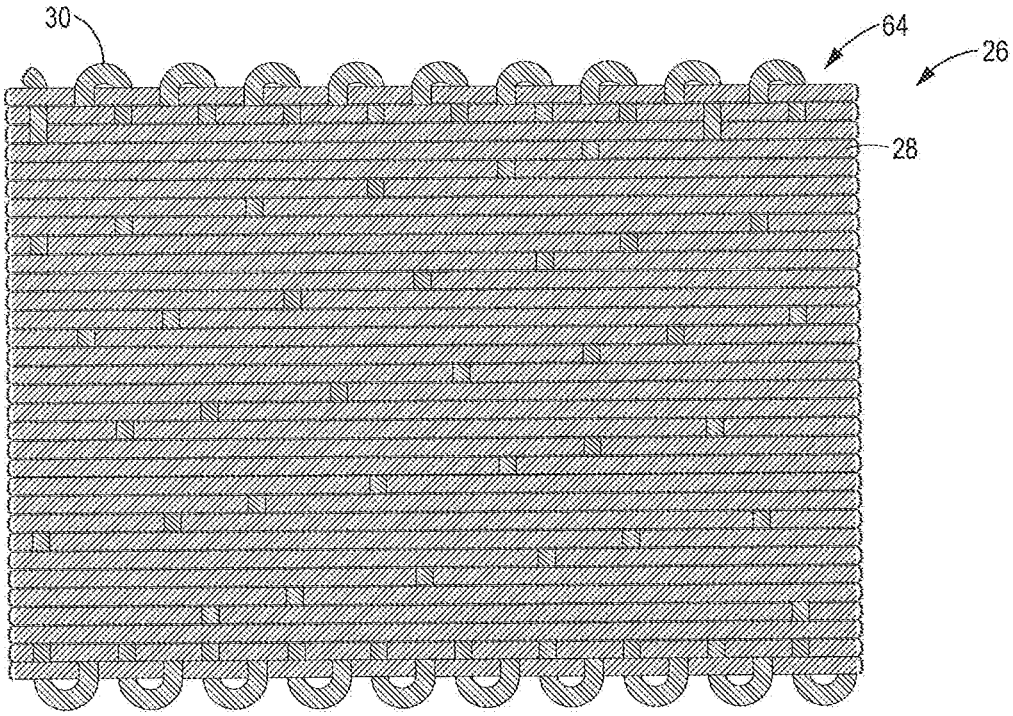
FIG. 5 is a side view of an embodiment of an interlaced heating layer having a satin weave pattern.
Figure 6:
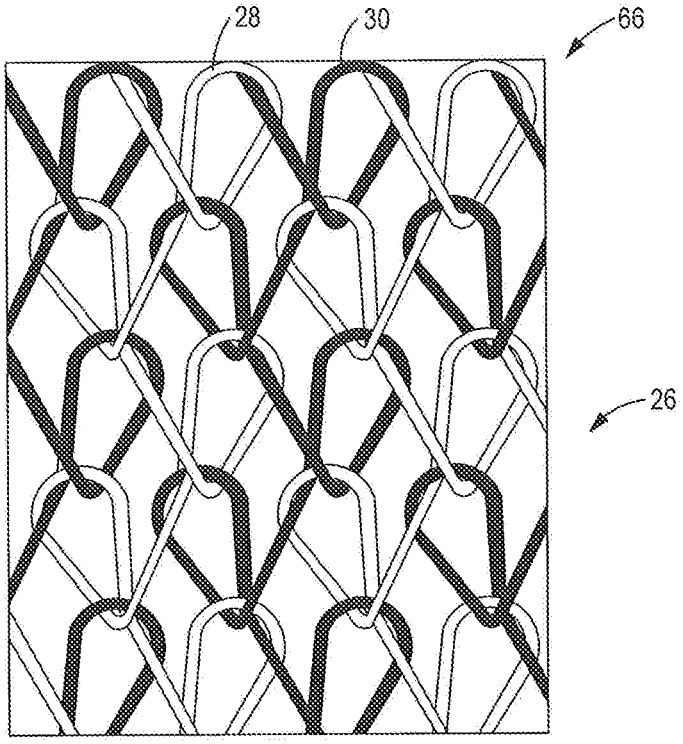
FIG. 6 is a side view of an embodiment of an interlaced heating layer having a knit pattern.

The fabric thread 28 and the heat-generating thread 30 are interlaced to provide flexibility to the interlaced heating layer 26, thereby allowing the interlaced heating layer 26 to conform to the contoured surface 23. The heat-generating thread 30 may be advantageously distributed evenly throughout the entire interlaced heating layer 26 to provide more uniform heating across the heating blanket 20. Furthermore, the particular type of interlacing may be sufficiently tight to physically support the heat-generating thread 30. Various types of patterns and processes may be used to form the interlaced heating layer 26. For example, the fabric thread 28 may form one or more weft yarns and the heat-generating thread 30 may form a warp yarn, in which case the fabric thread 28 and the heat-generating thread 30 may be woven together in a plain weave 60, as best shown in FIG. 2. Alternatively, other weave patterns for the fabric thread 28 and the heat-generating thread 30 may be used, such as a twill weave 62 (FIG. 4) or a satin weave 64 (FIG. 5), although any type of weave pattern may be used. In another example, the fabric thread 28 and the heat-generating thread 30 may be knitted together in a knitted pattern 66, as shown in FIG. 6. However, other fabric or textile producing processes than weaving and knitting may be used to form the interlaced heating layer 26 as well.

Figure 7:
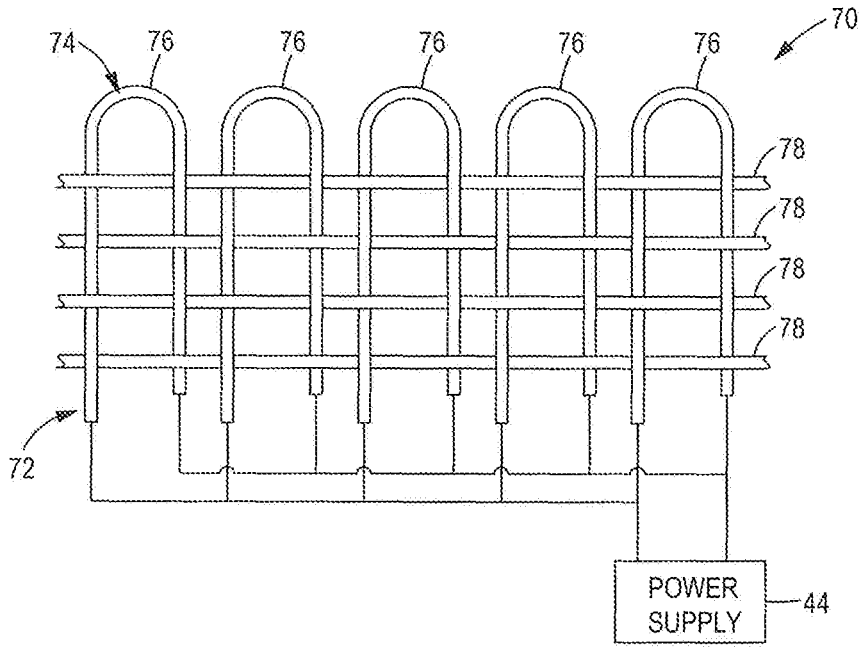
FIG. 7 is a schematic view of an embodiment of a conductor wire formed in a plurality of parallel circuits.

An alternative embodiment of an interlaced heating layer 70 is illustrated at FIG. 7. In this embodiment, the interlaced heating layer 70 includes a heat-generating thread 72 that includes a conductor wire 74 configured as a plurality of conductor wire circuits 76, thereby to balance the inductance and the resistance across the entire conductor wire 74. While the heat-generating thread 72 may also include a susceptor wire, as discussed above, the susceptor wire is not shown in FIG. 7 for purposes of clarity. The plurality of conductor wire circuits 33 are coupled in parallel to the power supply 44. One or more fabric threads 78 may be interlaced with the heat-generating thread 72, thereby to form the interlaced heating layer 70. While the illustrated embodiment shows five conductor wire circuits 33, a greater or fewer number of circuits may be used.

Figure 8:
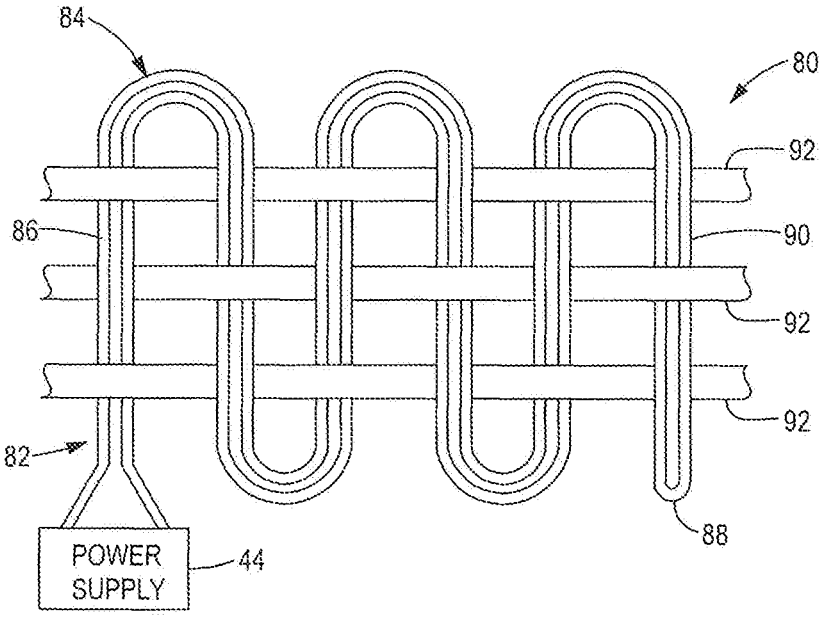
FIG. 8 is a schematic view of an embodiment of a conductor wire formed in a double-back configuration.

In another alternative embodiment illustrated at FIG. 8, an interlaced heating layer 80 includes a conductor wire arranged in a double-back configuration, thereby to at least partially cancel the longer-range electromagnetic field generated by the conductor wire. The interlaced heating layer 80 includes a heat-generating thread 82 having a conductor wire 84. The heat-generating thread 82 may also include a susceptor wire, but the susceptor wire is not shown in FIG. 8 for purposes of clarity. The conductor wire 84 includes a first segment 86 extending from the power supply 44 to a u-bend 88, and a second segment 90 extending from the U-bend 88 back to the power supply 44 and positioned directly adjacent the first segment 86. The first segment 86 is carries current in a first direction, while the second segment 90 carries current in a second direction opposite the first direction. Because the first and second segments 86, 90 will have the same current flowing in opposite directions, the double-back configuration advantageously at least partially cancels the longer-range electromagnetic field generated by the conductor wire 84. Additionally, the double-back configuration locates the ends of the conductor wire 84 adjacent each other, facilitating connection to the power supply 44 from a single end of the interlaced heating layer 80. One or more fabric threads 92 may be interlaced with the heat-generating thread 82 to complete the interlaced heating layer 80.

Figure 9:
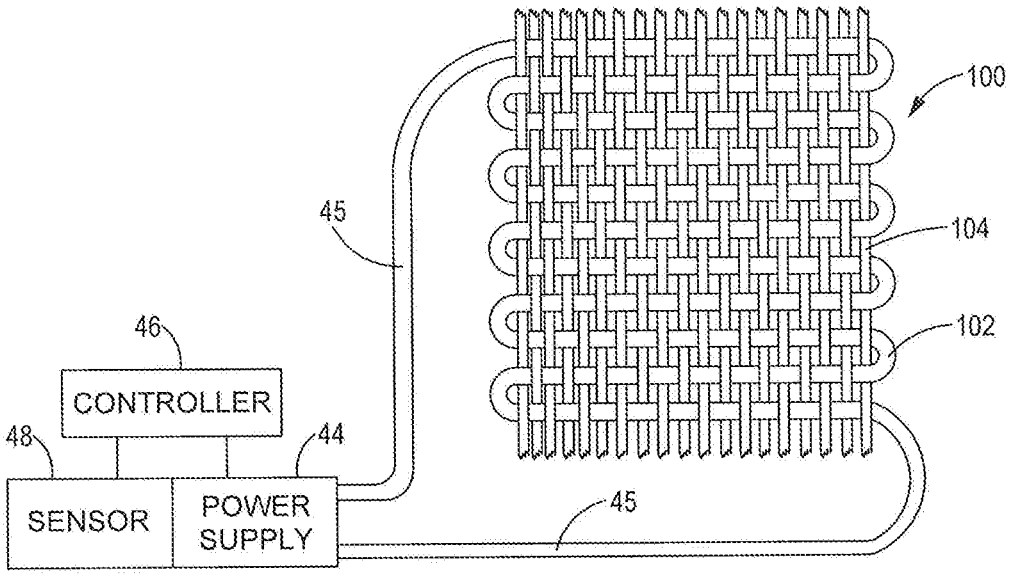
FIG. 9 is a schematic view of an embodiment of an interlaced heating layer using only a conductor wire and a susceptor wire.

In a further embodiment illustrated at FIG. 9, an interlaced heating layer 100 may be formed of just a conductor wire 102 and a susceptor wire 104, omitting the fabric thread. In this embodiment, instead of coiling the susceptor wire 104 around the conductor wire 102, the susceptor wire 104 is interlaced with the conductor wire 102 to form the interlaced heating layer 100. Any interlacing configuration may be used, including the weave and knit patterns disclosed herein, to interlace the conductor wire 102 and the susceptor wire 104 to form the interlaced heating layer 100 such that it readily conforms to a contoured surface. Furthermore, the conductor wire 102 and the susceptor wire 104 of the interlaced heating layer 100 are formed of materials suitable for use in high-temperature applications, such as the materials noted above.

In general, the foregoing disclosure provides numerous technical effects and benefits in various applications relating to high temperature heating blankets. For example, the disclosed heating blanket can be used to cure coatings, process and repair ceramic material, perform pipeline weldment repair, preheat welds, relieve stresses after welding, and other industrial, manufacturing, and repair applications requiring heating to at least 500° F. The disclosed heating blanket provides uniform, controlled heating of surface areas. More specifically, the Curie point of the susceptor wire in the interlaced heating layer is used to control temperature uniformity in the area to which the heating blanket is applied. All portions of the area being heated may achieve the same temperature, such as the Curie point of the susceptor wire, thereby helping to prevent over-heating or under-heating of certain portions of the area being heated. Additionally, the materials used for the fabric thread, conductor wire 32, and susceptor wire 34 are all selected to permit use of the heating blanket in high temperature applications.

Figure 10:
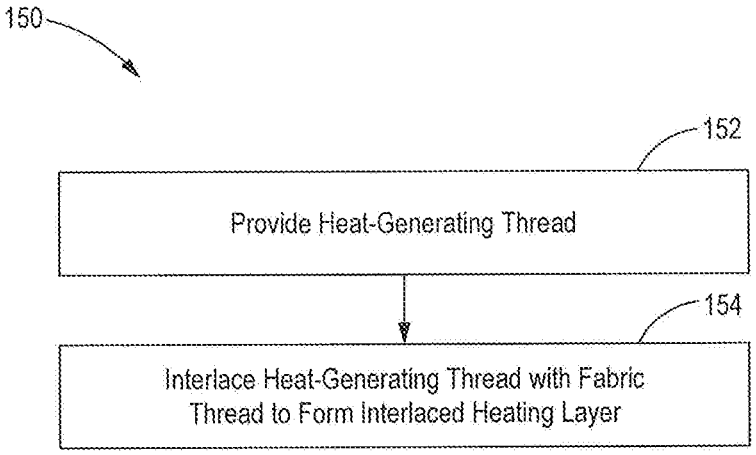
FIG. 10 is a flowchart illustrating a method of forming an interlaced heating layer of a heating blanket, in accordance with another embodiment of the present disclosure.

Referring now to FIG. 10, a method 150 of forming an interlaced heating layer 26 of a heating blanket 20 is shown, according to another embodiment of this disclosure. The method 150 begins at block 152, where a heat-generating thread 30 is provided. As discussed more fully above, the heat-generating thread includes a conductor wire 32 formed of a plurality of conductor wire strands 32*a* bundled in a Litz wire configuration. The conductor wire 32 is configured to generate a magnetic field in response to an electrical current applied to the conductor wire 32. The heat-generating thread 30 further includes a susceptor wire 34 formed of a susceptor material configured to inductively generate heat in response to the magnetic field of the conductor wire 32 when a temperature of the susceptor wire 34 is below a Curie point of the susceptor wire 34. As discussed more fully above, the susceptor wire 34 may be formed of a material capable of generating high temperature heat of at least 500° F. The method 150 continues at block 154, where the heat-generating thread 30 is interlaced with a fabric thread 28 to form the interlaced heating layer. The method 150 may optionally include forming first and second outer layers 22, 24 and positioning the first and second outer layers 22, 24 on opposite sides of the interlaced heating layer 26, thereby to protect the interlaced heating layer 26 and prevent a user from directly contacting the interlaced heating layer 26.

Figure 11:
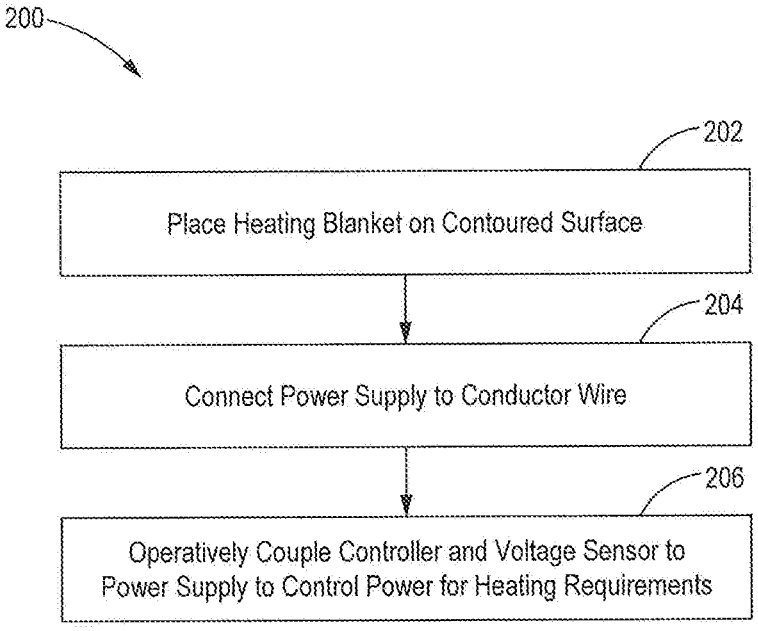
FIG. 11 is a flowchart illustrating a method of heating a contoured surface, in accordance with a further embodiment of the present disclosure.

Referring now to FIG. 11, a method 200 of heating a contoured surface is shown, according to another embodiment of this disclosure. The method 200 begins at block 202 by placing on the contoured surface 25 a heating blanket 20. The heating blanket 20 has an interlaced heating layer 26 that includes a fabric thread 28 formed of a high temperature fabric material, and a heat-generating thread 30 interlaced with the fabric thread 28. The heat-generating thread 30 includes a conductor wire 32 configured to generate a magnetic field in response to an electrical current applied to the conductor wire 32, and a susceptor wire 34 formed of a susceptor material configured to inductively generate heat in response to the magnetic field of the conductor wire 32. The susceptor wire 34 may be formed of a susceptor wire material capable of generating high temperature heat of at least 500° F. Furthermore, the susceptor wire material may have a Curie point at which the susceptor wire 34 reduces or ceases heat generation, thereby providing a smart response that generates more uniform heating temperatures across the entire heating blanket 20. The Curie point may approximate the maximum temperature provided by the heating blanket 20, and therefore in some embodiments may be at least 500° F. At block 204, the power supply is connected to the conductor wire 32 to form a circuit, such as via wiring 45. At block 206, a controller 46 and voltage sensor 48 may be operatively coupled to the power supply 44 to provide controlled power for various heating requirements.

It is to be understood that the flowcharts in FIGS. 10 and 11 are shown and described as examples only to assist in disclosing the features of the disclosed systems and techniques, and that more or less steps than that shown may be included in the processes corresponding to the various features described above for the disclosed systems without departing from the scope of this disclosure.

All references, including publications, patent applications, and patents, cited herein are hereby incorporated by reference. All methods described herein can be performed in any suitable order unless otherwise indicated herein or otherwise clearly contradicted by context. The use of any and all examples, or exemplary language (e.g., "such as") provided herein, is intended to illuminate the disclosed subject matter and does not pose a limitation on the scope of the claims. Any statement herein as to the nature or benefits of the exemplary embodiments is not intended to be limiting, and the appended claims should not be deemed to be limited by such statements. More generally, no language in the specification should be construed as indicating any non-claimed element as being essential to the practice of the claimed subject matter. The scope of the claims includes all modifications and equivalents of the subject matter recited therein as permitted by applicable law. Moreover, any combination of the above-described elements in all possible variations thereof is encompassed by the claims unless otherwise indicated herein or otherwise clearly contradicted by context. Additionally, aspects of the different embodiments can be combined with or substituted for one another. Finally, the description herein of any reference or patent, even if identified as "prior," is not intended to constitute a concession that such reference or patent is available as prior art against the present disclosure.

What is claimed is:

1. A heating blanket, comprising:
an interlaced heating layer including:
a fabric thread; and
a heat-generating thread interlaced with the fabric thread to form the interlaced heating layer, the heat-generating thread comprising:
a conductor wire configured to generate a magnetic field in response to an electrical current applied to the conductor wire, the conductor wire comprising a plurality of conductor wire strands bundled in a Litz wire configuration;
a susceptor wire wrapped around the conductor wire in a spiral configuration and formed of a susceptor material configured to inductively generate heat in response to the magnetic field of the conductor wire when a temperature of the susceptor wire is below a Curie point of the susceptor wire, wherein the susceptor material comprises a high temperature susceptor material selected from the group consisting of an iron alloy, a cobalt alloy, and a nickel alloy; and
a sheath surrounding the plurality of conductor wire strands.

2. The heating blanket of claim 1, in which the sheath comprises a ceramic filament.

3. The heating blanket of claim 1, in which the sheath comprises a thermoplastic film.

4. The heating blanket of claim 1, in which the fabric thread is formed of a high temperature fabric material selected from the group consisting of fiberglass, vermiculite fiberglass, and ceramic fiber.

5. The heating blanket of claim 1, in which the Curie point of the susceptor material is 2000° F.

6. The heating blanket of claim 1, in which the conductor wire comprises a plurality of conductor wire circuits connected in parallel.

7. The heating blanket of claim 1, in which the conductor wire is arranged in a double-back configuration, so that the conductor wire includes a first segment, configured to carry current in a first direction, and a second segment positioned adjacent the first segment and configured to carry current in a second direction opposite the first direction.

8. The heating blanket of claim 1, in which the Curie point of the susceptor material is at least 1000°.

9. A heating blanket, comprising:
an interlaced heating layer including:
a fabric thread; and
a heat-generating thread interlaced with the fabric thread to form the interlaced heating layer, the heat-generating thread comprising:
a conductor wire configured to generate a magnetic field in response to an electrical current applied to the conductor wire, the conductor wire comprising a plurality of conductor wire strands, wherein each conductor wire strand comprises a conductor wire metal core and a ceramic coating surrounding the conductor wire metal core; and
a susceptor wire formed of a susceptor material configured to inductively generate heat in response to the magnetic field of the conductor wire when a temperature of the susceptor wire is below a Curie point of the susceptor wire.

10. The heating blanket of claim 9, in which the conductor wire metal core comprises pure nickel.

11. The heating blanket of claim 9, in which the conductor wire metal core comprises nickel clad copper.

12. The heating blanket of claim 9, in which:
the plurality of conductor wire strands are bundled in a Litz wire configuration; and
the susceptor wire is wrapped around the conductor wire in a spiral configuration.

13. The heating blanket of claim 9, in which the Curie point of the susceptor material is at least 500° F.

14. The heating blanket of claim 9, in which;
the susceptor material comprises a high temperature susceptor material selected from the group consisting of an iron alloy, a cobalt alloy, and a nickel alloy; and
the fabric thread is formed of a high temperature fabric material selected from the group consisting of fiberglass, vermiculite fiberglass, and ceramic fiber.

15. The heating blanket of claim 12, further comprising a sheath surrounding the plurality of conductor wire strands.

16. The heating blanket of claim 15, in which the sheath comprises a ceramic filament.

17. A heating blanket, comprising:

an interlaced heating layer including:

a fabric thread;

a heat-generating thread interlaced with the fabric thread to form the interlaced heating layer, the heat-generating thread comprising:

a conductor wire configured to generate a magnetic field in response to an electrical current applied to the conductor wire, the conductor wire comprising a plurality of conductor wire strands bundled in a Litz wire configuration, wherein each conductor wire strand of the plurality of conductor wire strands is formed of an electrically conductive material suitable for temperatures of at least 1000° F., and wherein each conductor wire strand of the plurality of conductor wire strands has a coating comprising a ceramic material; and a susceptor wire formed of a susceptor material configured to inductively generate heat in response to the magnetic field of the conductor wire when a temperature of the susceptor wire is below a Curie point of the susceptor wire; and a pair of outer layers sandwiching opposite sides of the interlaced heating layer, each outer layer being formed of an outer layer fabric material.

18. The heating blanket of claim 17, in which the susceptor wire is wrapped around the conductor wire in a spiral configuration.

19. The heating blanket of claim 17, in which the Curie point of the susceptor material is at least 500° F.

20. The heating blanket of claim 17, in which;

the susceptor material comprises a high temperature susceptor material selected from the group consisting of an iron alloy, a cobalt alloy, and a nickel alloy; and the fabric thread is formed of a high temperature fabric material selected from the group consisting of fiberglass, vermiculite fiberglass, and ceramic fiber.

* * * * *